US006377159B1

(12) United States Patent
Yu

(10) Patent No.: US 6,377,159 B1
(45) Date of Patent: Apr. 23, 2002

(54) PUSH BUTTON CIRCUIT BREAKER SWITCH

(76) Inventor: Tsung-Mou Yu, No. 4, Alley 2, Lane 23, Sec. 3, Pa-Te Raod, Pao-Chiao City, Taipei (TW)

( * ) Notice: Subject to any disclaimer, the term of this patent is extended or adjusted under 35 U.S.C. 154(b) by 0 days.

(21) Appl. No.: 09/501,959

(22) Filed: Feb. 10, 2000

(30) Foreign Application Priority Data

Feb. 12, 1999 (CN) ..... 88202641 U

(51) Int. Cl.[7] ..... H01H 37/02; H01H 37/32; H01H 37/46; H01H 37/52

(52) U.S. Cl. ..... 337/37; 337/39; 337/59; 337/85; 337/112; 337/113

(58) Field of Search ..... 337/59, 66–69, 337/76, 79, 53, 74, 75, 85, 39, 91, 112, 113, 140, 334, 345; 200/553–557

(56) References Cited

U.S. PATENT DOCUMENTS

| | | | | | |
|---|---|---|---|---|---|
| 2,955,177 | A | * | 10/1960 | Brackett | 200/116 |
| 4,068,203 | A | * | 1/1978 | Unger | 337/56 |
| 4,363,016 | A | * | 12/1982 | Unger | 337/56 |
| 4,528,538 | A | * | 7/1985 | Andersen | 337/43 |
| 4,704,594 | A | * | 11/1987 | Krasser | 337/66 |
| 4,780,697 | A | * | 10/1988 | Cobb, III et al. | 337/70 |
| 4,833,439 | A | * | 5/1989 | Bowden et al. | 337/68 |
| 5,001,450 | A | * | 3/1991 | Wu | 337/68 |
| 5,153,552 | A | * | 10/1992 | Krasser | 337/66 |
| 5,157,369 | A | * | 10/1992 | Yao | 337/68 |
| 5,248,954 | A | * | 9/1993 | Chiang | 337/66 |
| 5,453,725 | A | * | 9/1995 | You et al. | 337/68 |
| 5,786,742 | A | * | 7/1998 | Yin | 337/66 |
| 5,854,585 | A | * | 12/1998 | Kingma | 337/367 |
| 5,936,505 | A | * | 8/1999 | Yu | 337/66 |
| 6,121,868 | A | * | 9/2000 | Chiang | 337/37 |
| 6,229,426 | B1 | * | 5/2001 | Lavado et al. | 337/57 |

FOREIGN PATENT DOCUMENTS

| | | | | |
|---|---|---|---|---|
| DE | 3313465 A1 | * | 10/1984 | 337/36 |
| FR | 2766007 A1 | * | 1/1999 | H01H/13/14 |

* cited by examiner

*Primary Examiner*—Gerald Tolin
*Assistant Examiner*—Anatoly Vortman
(74) *Attorney, Agent, or Firm*—Senniger, Powers, Leavitt & Roedel

(57) ABSTRACT

A circuit breaker switch essentially comprising a push button switch, an alloy metal having one end connected to a contact of a circuit of the switch and the other end being mounted to the circuit of the switch. If the current to the switch does not exceed a predetermined current value, the switch functions as a normal switch. That is, the original position of the switch is in the "OFF" position and a depression to the push button changes its position to the "ON" state. A further depression of the push button restores the push button to the "OFF" state. When the current passed to the switch exceeds the predetermined current valve, the alloy metal is thermally deformed and curved upward, which forms a gap to allow an insulating plate to be inserted to cut off the current supply and open the circuit. The switch restores to its function by resetting the push button.

5 Claims, 7 Drawing Sheets

PUSH BUTTON CIRCUIT BREAKER SWITCH

BACKGROUND OF THE INVENTION

1. Field of the Invention

The present invention relates to a push button circuit breaker switch and in particular, relates to a switch employing an alloy metal which deforms while its temperature rises to a specific point. A circuit is closed or opened automatically when the current via the switch has exceeds a predetermined current value.

2. Description of the Prior Art

FIG. 1 shows an exploded view of a prior art push button switch. When the push button 1 is at the top position of a housing before it is depressed, the contact 206 of a conductive plate 204 and the contact 210 of the connecting leg 208 are separated from each other. When the push button 202 is depressed, the protruded rod 212 of the push button 1 triggers the conductive plate 204 such that the contact 206 contacts with the contact 210.

Thus, the switch is shifted to a conductively connected state. However, this switch provides only the function of ON and OFF, it can not automatically cut off the circuit at a specified current value. As there is no automatic current breaking device in the switch, manual operation is required to shift from ON or OFF state. In order to automatically cut off the current supply to the circuit, there are different kinds of fuse devices available. However, it is not convenient to replace a fuse when it melts. Further, it is necessary to keep a number of fuses in stock for ready use.

In other conventional art, a safety device is employed after the circuit is opened such that by depressing a button thereof, the switch can be restored and ready to use. However, in this prior art, the circuit is very complicated as an additional safety device has to be installed. It is not economical due to greater costs of material, installation and fabrication.

U.S. Pat. No. 5,786,742 relates to a push button switch with an override interruption structure. Referring to FIGS. 1, 2 and 4 to 8 of the patent, the switch comprises a push button 1 connected to contacts 61, 62. When the push button 1 is depressed, the contacts 61, 62 respectively contact with the contacts 731 and 461 of a first conductive plate 73 and a second conductive plate 46 such that the switch is switched to the ON state. This switch employs a well-known mechanism such that when the button 1 is depressed, it remains in the pressed-down position, and the button 1 restores to its original position to open the circuit when the button 1 is depressed once again. In addition, the switch comprises a circuit cut-off device, and when the alloy 75 is overheated, it deforms and causes the push button 1 to be released. Thus the push button 1 restores to its original position, and the contacts are separated. The switch is changed from the ON state to the OFF state.

SUMMARY OF THE PRESENT INVENTION

The present invention relates to a push button circuit breaker switch which comprises a housing having an opening; a push button fitted to the opening within the housing; a press rod being mounted below the push button and being moveable vertically, and including a contacting rod; a spring being mounted under the press rod, such that the press rod displaces downwards to urge said spring; a conductive plate mounted at the housing and having a resilient plate with a contact, such that the press rod displaces downwards to compress said resilient plate; a first conductive terminal positioned at the housing and having a connecting leg end and a contact, the connecting leg end being protruded out of the housing such that the compression of the resilient plate of the conductive plate causes the contact thereof to contact with the contact of the first conductive terminal; an alloy metal having one end being secured to the conductive plate and having a contact at the other end; a second conductive terminal being secured to the housing and having a connecting leg end and a contact, the connecting leg end being protruded out of the housing, the contact being connected to the contact of the alloy metal before the alloy metal is heated and deformed; an insulating plate having an insulating end and being mounted with a compression spring; a triangular passage being mounted at the housing; an interlinking rod having one end pivotally mounted at the press rod and having the other end being connected to the passage; whereby the pushing of said push button changes the switch from "OFF" position to the "ON" position, and when the current passed through the switch has exceeded a predetermined current value, the alloy metal curves at that instance and the contact of the alloy metal disengage from the contact of the second conductive terminal, and as a result of the force of the spring, the insulating end of the insulating plate moves into the gap formed between the two contacts, a second push on the push button resets the switch to OFF position.

Another object of the present invention is to provide a push button circuit breaker switch, which is reliable and inexpensive to manufacture.

Yet another object of the present invention is to provide a push button circuit breaker switch which can automatically switch off the current supply.

BRIEF DESCRIPTION OF THE DRAWINGS

The foregoing and other objects, features and advantages of the invention will be apparent from the following more specific description of the preferred embodiment of the invention, as illustrated in the accompanying drawings in which like reference characters refer to the same parts by means of different views.

DETAILED DESCRIPTION OF THE PREFERRED EMBODIMENT

Figure 1:
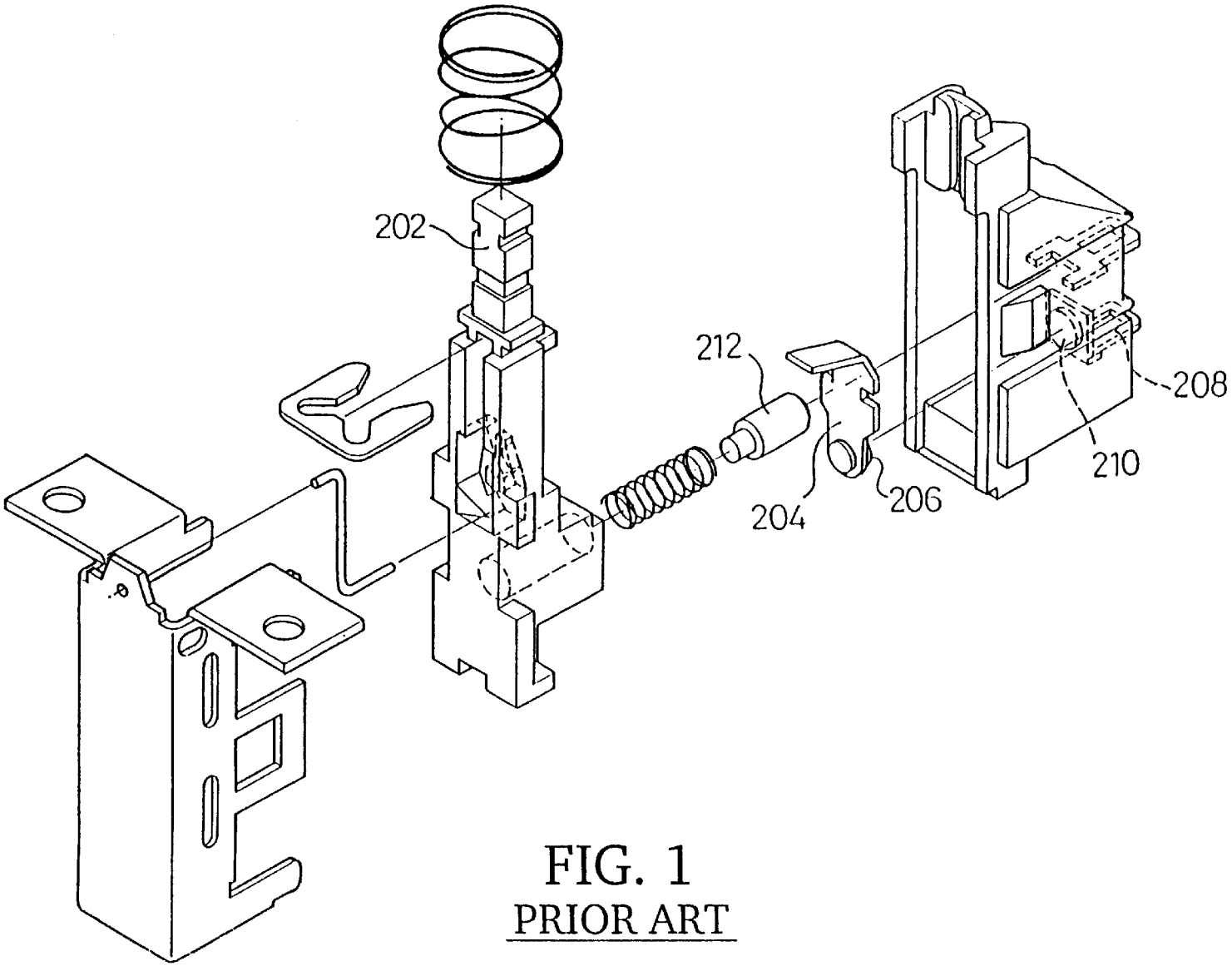
FIG. 1 PRIOR ART
FIG. 1 is an exploded view of a conventional push button switch.
Figure 2:
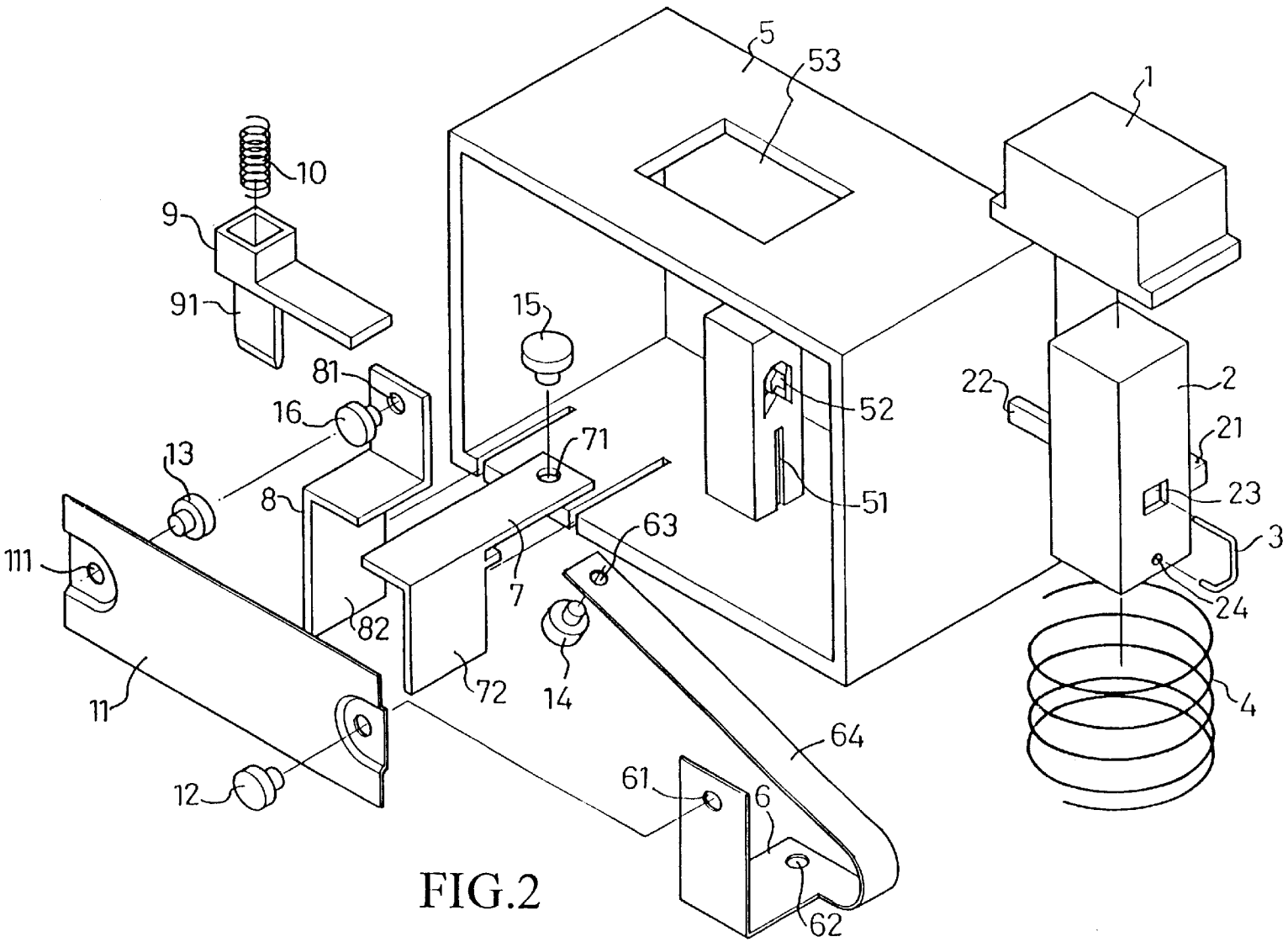
FIG. 2 is a perspective exploded view of a push button circuit breaker switch in accordance with the present invention.

Referring to FIG. 2, there is shown a push button circuit breaker switch comprising a housing 5, a triangular passage 52, a push button 1, a press rod 2, a conductive plate 6, two conductive terminals 7, 8, an insulating plate 9, and an alloy metal 11.

In accordance with the present invention, the internal structure of the circuit breaker switch is shown in FIG. 3, wherein the housing 5 is provided with an opening 53. The triangular passage 52 is mounted within the housing 5 and the structure is shown in details in FIG. 6.

Figure 6:
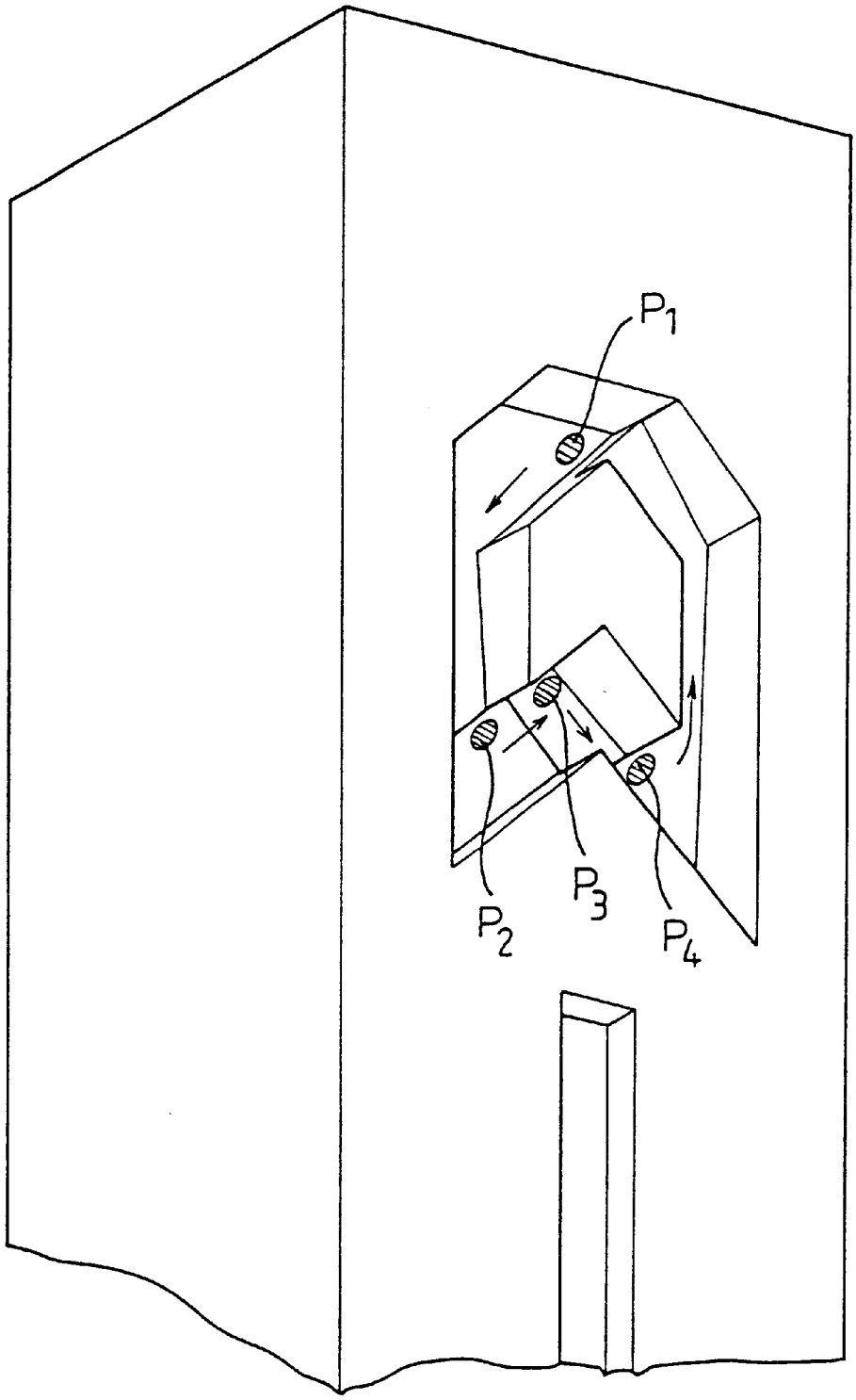
FIG. 6 is a detailed diagram of the triangular passage in accordance with the present invention.

As the structure of the triangular passage 52 is a prior art (which is shown in FIG. 6), the details with respect to the structure and operation are obvious to those skilled in the art and need not be described herein.

The triangular passage 52 is substantially an elongated body being mounted with a spring 4 at the exterior of the body. At the lateral surface of the press rod 2, a contacting rod 21 is provided such that when the press rod 2 is at the top of the spring 4, the contacting rod 21 urges the spring 4. The push button 1 is mounted on the top of the press rod 2 and the bottom section thereof forms a protruded edge such that the portion over the protruded edge projects out to the housing 5 and the protruded edge is held within the body 5. Thus, under the pushing force rendered by the spring 4, the push button 1 will not dislocate from its position.

Referring to FIG. 3, an interlinking rod 3 has a pivotal end 31 and a moving end 32, wherein the pivotal end 31 is inserted into an insertion hole 24 of the press rod 2, and the moving end 32 is inserted into an insertion hole 23 on the triangular passage 52.

The conductive plate 6 is mounted on the housing 5, having one end being formed with a resilient plate 64.

Referring again to FIG. 2, a connection hole 63 is provided on the resilient plate 64 and is connected with a contact 14. The other end of the conductive plate 6 is provided with a rivet hole 61. One end of the alloy metal 11 is also provided with a rivet hole 112, and by means of a rivet 12, the alloy metal 11 and the conductive plate 6 are mounted together. The other end of the alloy metal 11 is provided with a connection hole 111, which is fastened with a contact 13.

In accordance with the present invention, one end of the conductive terminal 7 is provided with a connection hole 71 and is fastened with a contact 15. The contact 15 corresponds to the contact 14. The other end of the first conductive terminal 7 is a connecting leg end 72, which is extending out of the housing 5. The second conductive terminal 8 is fixed at a position adjacent to the first conductive terminal 7, the terminal 8 has a hole 81 which is mounted with a contact 16. The contact 16 corresponds to the contact 13. The other end of the second conductive terminal 8 is a connection leg end 82. Similarly, it is extending out of the housing 5.

Figure 3C:
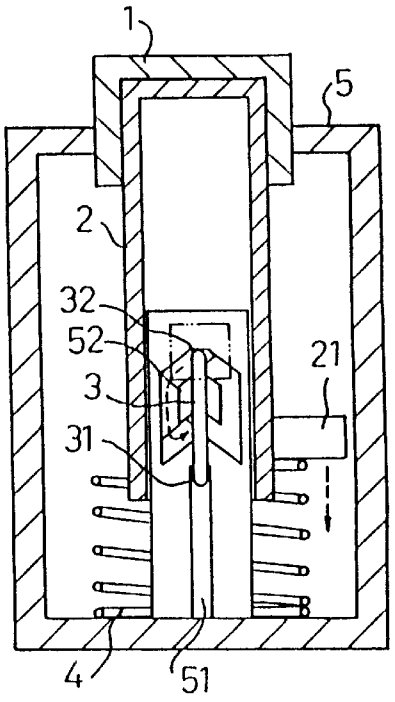
FIG. 3C is the sectional view of the circuit breaker along line 3C—3C FIG. 3A.
Figure 3A:
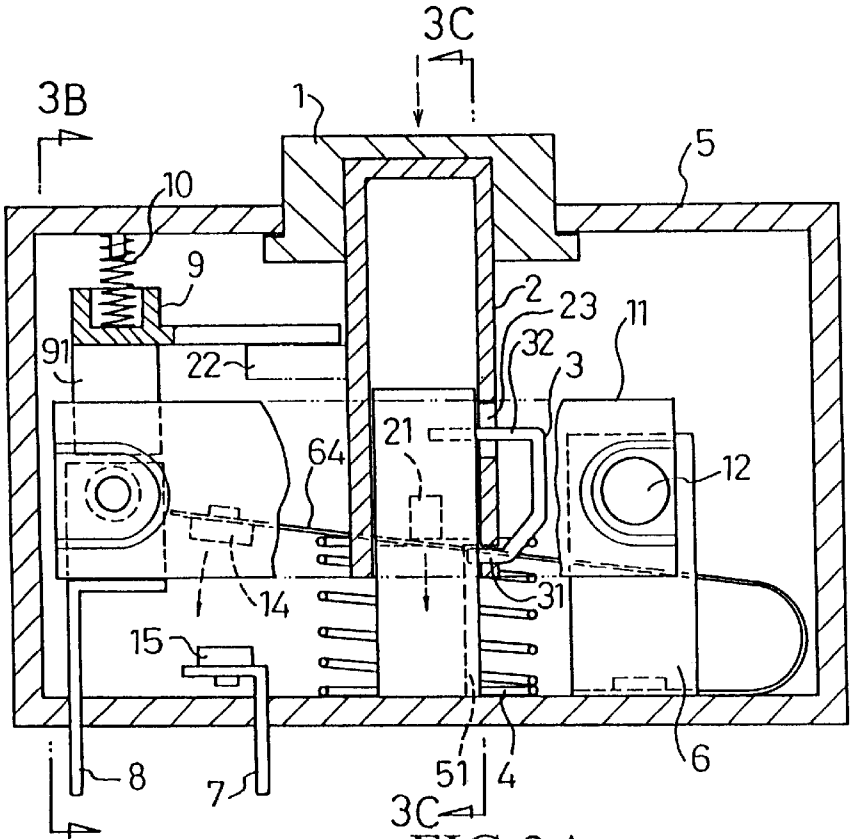
FIG. 3A shows the state of the breaker switch at "OFF" position in accordance with the present invention.
Figure 3B:
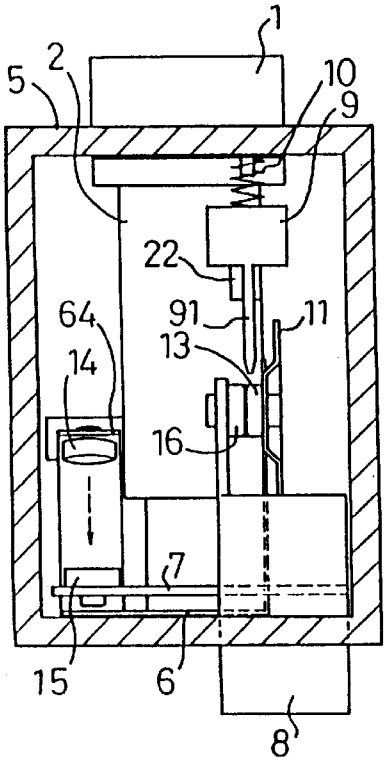
FIG. 3B is the sectional view of the circuit breaker along line 3B—3B of FIG. 3A.

FIGS. 3A, 3B and 3C illustrate the state of the switch in the OFF position. At this instance, the push button 1 as well as the press rod 2 is in the state not yet being pressed down, the spring 4 is at its normal position and the contacts 14, 15 are separated. Thus, the first terminal 7 and the second terminal 8 are not conductively connected. In addition, the insulating plate 9 is urged by the spring 10 but it is also supported by the push rod 22 such that it maintains at the position as shown in the figures.

Figure 4C:
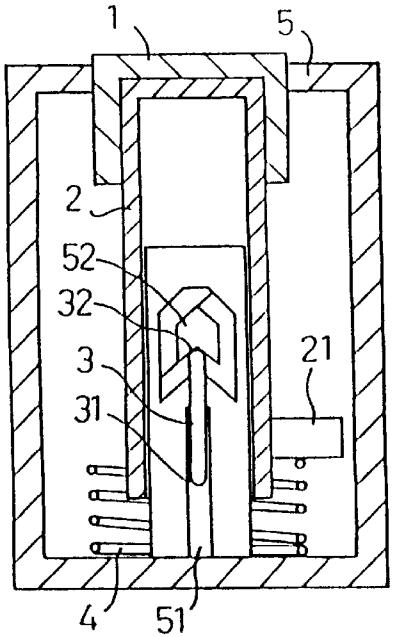
FIG. 4C is the sectional view of the circuit breaker along line 4C—4C of FIG. 4A.
Figure 4A:
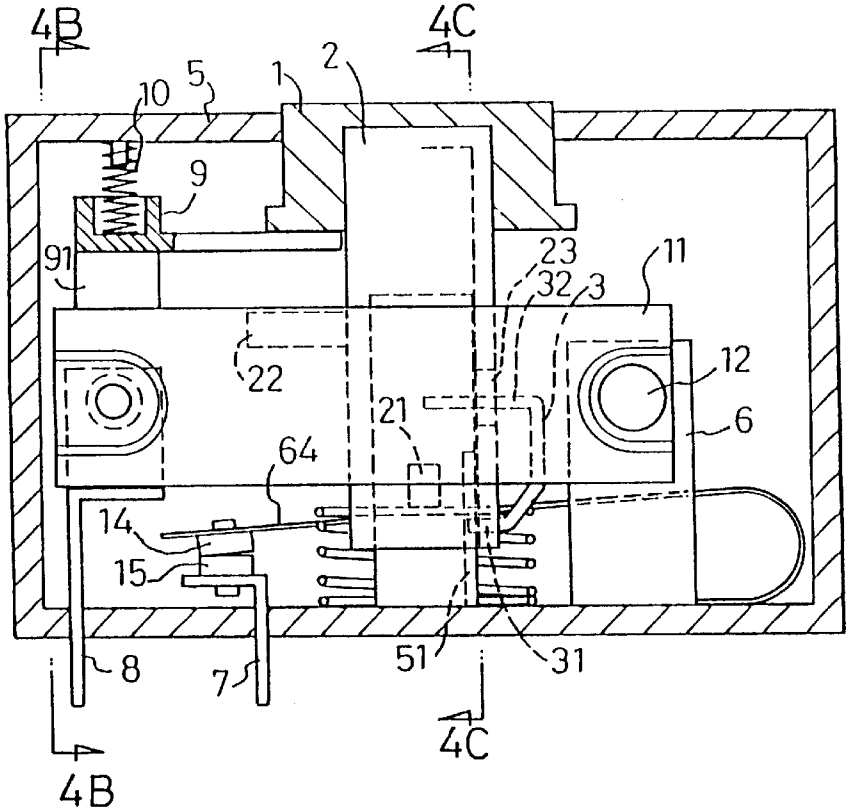
FIG. 4A shows the state of the circuit breaker switch in the "ON" position in accordance with the present invention.
Figure 4B:
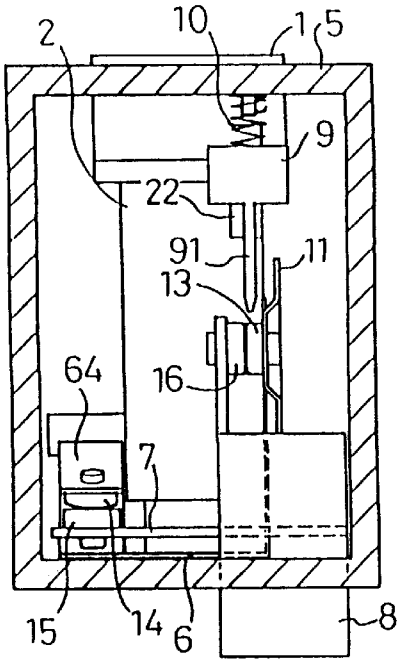
FIG. 4B is the sectional view of the circuit breaker along line 4B—4B of FIG. 4A.

In accordance with the present invention, when the push button 1 is pressed, the press rod 2 is also being pressed simultaneously. The contacting rod 21 of the press rod 2 pushes the spring 4 and the resilient plate 64 which causes the contact 14 to be in touch with the contact 15. In addition, the moving end 32 of the interlinking rod 3 will move from position $P_1$ to $P_2$ shown in FIG. 6. When the push button 1 is released, the moving end 32 will move to the position $P_3$, as shown in FIGS. 4A, 4B and 4C, at which position the switch will be in the "ON" state.

When the push button 1 is pressed once more, the interlinking rod 3 is moved downwards by the press rod 2 and the moving end 32 moves to the $P_4$ position along the specified direction in FIG. 6. When the push button 1 is released, the interlinking rod 3, as a result of the spring 4, is moved upwards by the press rod 2. Thus, the moving end 32 returns to $P_1$ position. At this moment, the conductive plate 6 is not pressed and returns to its original position. Thus, the contact 14 and the contact 15 are separated from each other, and the first conductive terminal 7 and the second conductive terminal 8 are not conductively connected. At this point, the switch returns to its "OFF" state as shown in FIG. 3.

Referring to FIGS. 4A, 5A, 5B and 5C, if the switch is in the "ON" state, and the current carried by the circuit exceeds a predetermined level, the temperature of the alloy metal 11 is continuously elevated. When the temperature exceeds a specified temperature, the alloy metal 11 will curve instantaneously. Thus, the contact 13 of the alloy metal 11 shits away from the contact 16, and the insulating plate end 91 of the insulating plate 9 inserts into the gap formed between the contact 13 and the contact 16 as a result of the force of the spring 10. Thus, the first conductive terminal 7 and the second conductive terminal 8 are not conductively connected and the switch is in the "OFF" state. Thus, the object of current breaking of the switch is attained.

In accordance with the present invention, the alloy metal 11 having the above characteristics can be made from memory alloys, and the shape of the alloy metal is made in such a way that when the temperature is at a specified temperature, the alloy metal curves upward. On the contrary, when the temperature is lowered to a specified temperature, the alloy metal restores to its original shape.

Figure 7A:
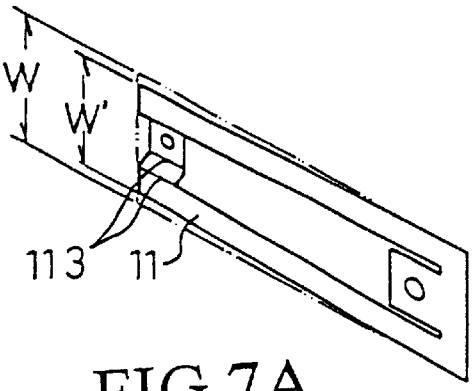
FIGS. 7A–7C show various shapes of the alloy metal in accordance with the present invention.
Figure 7B:
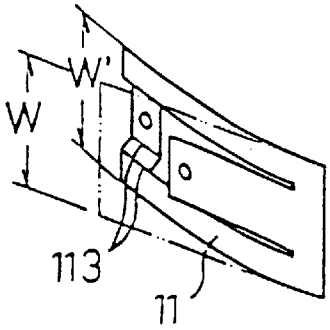
Figure 7C:
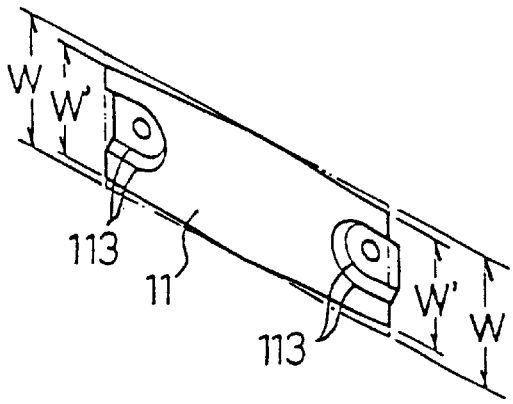

In order to attain the above object at least one end of the alloy metal 11 is fabricated in such a way that its width is smaller than its original width. FIGS. 7A, 7B and 7C shows alloy of different shapes, wherein at least one end there-of has a bent section 113 with a width W' smaller than its original width W. Thus, the alloy metal 11 can be bent to a reverse side when the temperature has attained to a specified temperature.

Figure 5C:
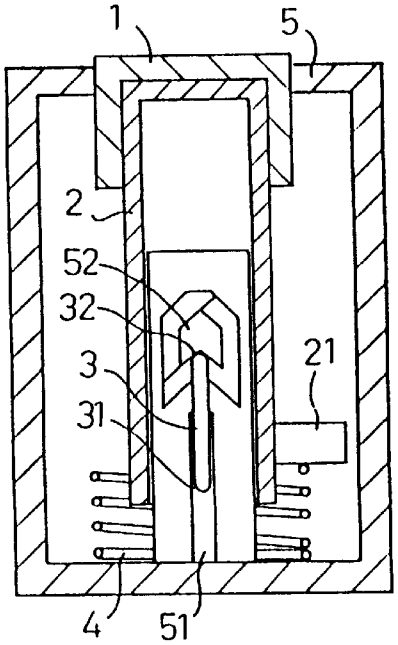
FIG. 5C is the sectional view of the circuit breaker along line 5C—5C of FIG. 5A.
Figure 5A:
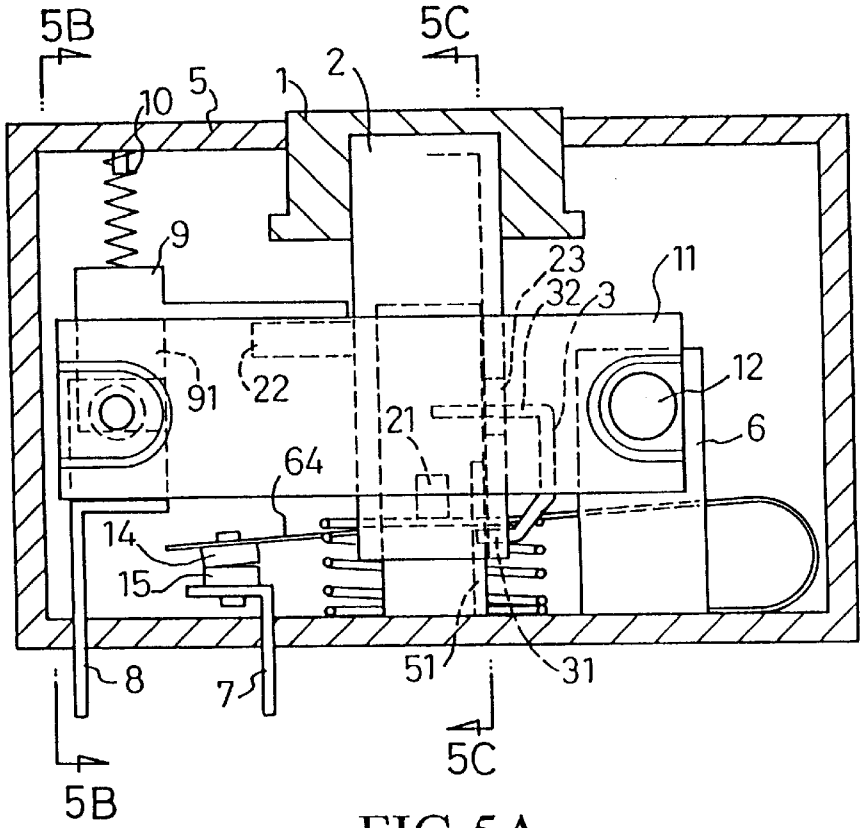
FIG. 5A shows schematic view of the curving up of the alloy metal and the insulation of the contacts of the present invention.
Figure 5B:
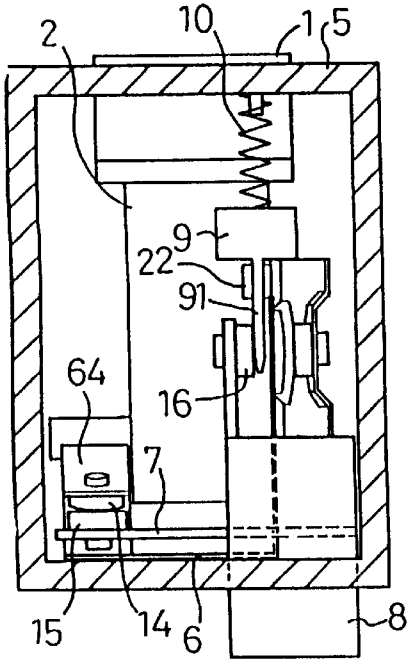
FIG. 5B is the sectional view of the circuit breaker along line 5B—5B of FIG. 5A.

Referring to FIGS. 5A and 5B, the insulating end 91 is shown positioned between the contact 13 and the contact 16, and a reset has to be made to the button 1 so that the switch can function normally. The reset operation is carried out by pressing the push button 1. When the press button 1 is pressed, the moving end 32 of the interlinking rod 3 moves from $P_3$ to $P_1$ position, and the press rod 2 is pushed upward by the spring 4, and the resilient plate restores to its original position. The contact 14 separates from the contact 15 and the push rod 22 pushes the insulating plate 9 upwards, such that the insulating end 91 withdraws itself from the contact 13 and contact 16. Thus, the switch returns to its original state shown in FIG. 3A.

While this invention has been particularly shown and described with references to a preferred embodiment, it will be understood by those skilled in the art that various changes in form and details may be made therein without departing from the spirit and scope of the invention as defined by the appended claims.

What is claimed is:

1. A push button circuit breaker switch comprising:

a housing having an opening;

a push button in combination with said opening within the housing;

a press rod being mounted under said push button and being moveable vertically, and including a contacting rod;

a spring being mounted below said press rod, such that downward displacement of said press rod urges said spring;

a conductive plate mounted at the housing and having an resilient plate with a contact, such that the downward displacement of the press rod causes a compression on said resilient plate;

a first conductive terminal positioned at the housing and having a connecting leg end and a contact, the connecting leg end protruding from the housing, such that the compression of the resilient plate of the conductive plate causes the contact thereof to contact with the contact of the first conductive terminal;

an alloy metal having one end secured to the conductive plate and having a connection point at the other end;

a second conductive terminal secured to the housing and having a connecting leg end and a contact, the connecting leg end protruding from the housing, the contact being connected to the contact of the alloy metal before the alloy metal is heated and deformed;

an insulating plate having an insulating end and being mounted with a compression spring;

a triangular passage mounted at the housing; and a interlinking rod having one end pivotally mounted at the press rod and having the other end connected with the passage; whereby the pushing of said push button changes the switch from "OFF" position to the "ON" position and when the current passing through the switch has exceeded a predetermined current value, the alloy metal curves at that instance and the contact of the alloy metal disengages from the contact of the second conductive terminal, and as a result of the force of the spring, the insulating end of the insulating plate moves into the gap formed between the two contacts, a second push on the push button resets the switch to the OFF position.

2. The push button circuit breaker switch as set forth in claim 1, wherein a further push rod is mounted to the press rod such that the resetting of the switch causes the insulating plate to separate the contact of the alloy metal and that of the second conductive terminal.

3. The push button circuit breaker switch as set forth in claim 2, wherein the alloy metal is made from memory alloy.

4. The push button circuit breaker switch as set forth in claim 3, wherein at least one end of the alloy metal is fabricated to a width smaller than the original width, which allows a reverse curvature when temperature is elevated to a specific value.

5. The push button circuit breaker switch as set forth in claim 3, wherein the ends of the alloy metal are fabricated to a width smaller than the original width.

* * * * *